US010203145B2

(12) United States Patent
Bates et al.

(10) Patent No.: US 10,203,145 B2
(45) Date of Patent: Feb. 12, 2019

(54) SYSTEMS AND METHODS FOR REDUCING AIR LOSSES IN REFRIGERATED CASES

(71) Applicant: Hill Phoenix, Inc., Conyers, GA (US)

(72) Inventors: Roy Bates, Chesterfield, VA (US); Lawrence W. Eget, Mechanicsville, VA (US)

(73) Assignee: Hill Phoenix, Inc, Conyers, GA (US)

( * ) Notice: Subject to any disclaimer, the term of this patent is extended or adjusted under 35 U.S.C. 154(b) by 0 days.

(21) Appl. No.: 15/677,250

(22) Filed: Aug. 15, 2017

(65) Prior Publication Data

US 2018/0106524 A1 Apr. 19, 2018

Related U.S. Application Data

(60) Provisional application No. 62/408,894, filed on Oct. 17, 2016.

(51) Int. Cl.
*A47F 3/04* (2006.01)
*A47B 96/04* (2006.01)
(Continued)

(52) U.S. Cl.
CPC ..... *F25D 17/045* (2013.01); *A47B 96/04* (2013.01); *A47F 3/0408* (2013.01);
(Continued)

(58) Field of Classification Search
CPC ..... F25D 13/045; F25D 13/02; F25D 23/06; F25D 23/065; F25D 23/069;
(Continued)

(56) References Cited

U.S. PATENT DOCUMENTS 3,365,907 A * 1/1968 Barroero ..... A47F 3/0443 62/256
3,392,543 A * 7/1968 Miller ..... A47F 3/0443 62/237

(Continued)

FOREIGN PATENT DOCUMENTS

JP 2001120398 A * 5/2001
JP 2005-304927 4/2005

OTHER PUBLICATIONS

English machine translation of JP2001-120398 (Year: 2018).*
Extended European Search Report and Opinion regarding European Application No. 7195816.8, dated Feb. 5, 2018, 9 pps.

*Primary Examiner* — Daniel J Rohrhoff
(74) *Attorney, Agent, or Firm* — Foley & Lardner LLP

(57) ABSTRACT

A refrigerated display case includes a frame, a door, and a lateral flow barrier. The frame includes a first mullion and a second mullion. The frame defines a common refrigerated zone. The door is hingedly mounted to the first mullion. The door is configured to selectively interface with the second mullion. The lateral flow barrier is coupled to one of the first mullion and the second mullion. The lateral flow barrier extends into the common refrigerated zone. The lateral flow barrier partially separates the common refrigerated zone into an first sub-compartment proximate the door and bounded by the lateral flow barrier and an second sub-compartment opposite the first sub-compartment. The lateral flow barrier is not thermally insulating.

9 Claims, 4 Drawing Sheets

(51) Int. Cl.
*F25D 17/04* (2006.01)
*F25D 23/06* (2006.01)

(52) U.S. Cl.
CPC ..... *A47F 3/0426* (2013.01); *F25D 23/069* (2013.01); *F25D 2317/063* (2013.01); *F25D 2323/021* (2013.01)

(58) Field of Classification Search
CPC ..... F25D 2323/06; F25D 2400/006; A47F 3/0408; A47F 3/0413; A47F 3/0417
See application file for complete search history.

(56) References Cited

U.S. PATENT DOCUMENTS 3,528,258 A * 9/1970 Brennan ..... A47F 3/0447 454/193
3,690,118 A * 9/1972 Rainwater ..... A47F 3/0447 62/237
4,058,989 A * 11/1977 Horvay ..... F25D 11/02 454/188
4,369,631 A * 1/1983 Abraham ..... F25D 21/125 62/255
2010/0077781 A1* 4/2010 Decker ..... A47B 96/021 62/251

* cited by examiner

SYSTEMS AND METHODS FOR REDUCING AIR LOSSES IN REFRIGERATED CASES

CROSS-REFERENCE TO RELATED APPLICATION

This application claims the benefit of priority to U.S. Provisional Patent Application No. 62/408,894, which was filed on Oct. 17, 2016, the complete disclosure of which is incorporated by reference herein.

FIELD

Embodiments of the present disclosure relate to systems and methods for reducing air losses in refrigerated cases.

BACKGROUND

Typically, a refrigerated display case has several doors which provide access to products located on shelves in a single refrigerated zone. While products may be separated on shelves according to which door they are proximate to, they may be similarly cooled within the refrigerated zone. When the doors are opened, ambient (e.g., warm) air may enter the refrigerated display case and cooled air from the refrigerated display case may exit the refrigerated display case. Both the loss of refrigerated air and the accrual of ambient air causes a refrigerated display case to operate inefficiently and undesirably.

SUMMARY

Systems, methods, and apparatuses for a refrigerated display case and for a lateral flow barrier are shown and described. In one embodiment, the refrigerated display case includes a frame, a door, and a lateral flow barrier. The frame includes a first mullion and a second mullion. The frame defines a common refrigerated zone. The door is hingedly mounted to the first mullion. The door is configured to selectively interface with the second mullion. The lateral flow barrier is coupled to one of the first mullion and the second mullion. The lateral flow barrier extends into the common refrigerated zone. The lateral flow barrier partially separates the common refrigerated zone into an first sub-compartment proximate the door and bounded by the lateral flow barrier and an second sub-compartment opposite the first sub-compartment. The lateral flow barrier is not thermally insulating.

In another embodiment, the lateral flow barrier for use within a refrigerated display case includes a front edge and a bottom edge. The front edge is configured to be coupled to a mullion of the refrigerated display case. The bottom edge is configured to abut a bottom surface of the refrigerated display case. The lateral flow barrier partially separates a common refrigerated zone into an first sub-compartment and an second sub-compartment opposite the first sub-compartment. The first sub-compartment is proximate a door of the refrigerated display case. The lateral flow barrier impedes lateral air flow between the second sub-compartment and the first sub-compartment.

These and other features, together with the organization and manner of operation thereof, may become apparent from the following detailed description when taken in conjunction with the accompanying drawings.

DETAILED DESCRIPTION

Figure 1:
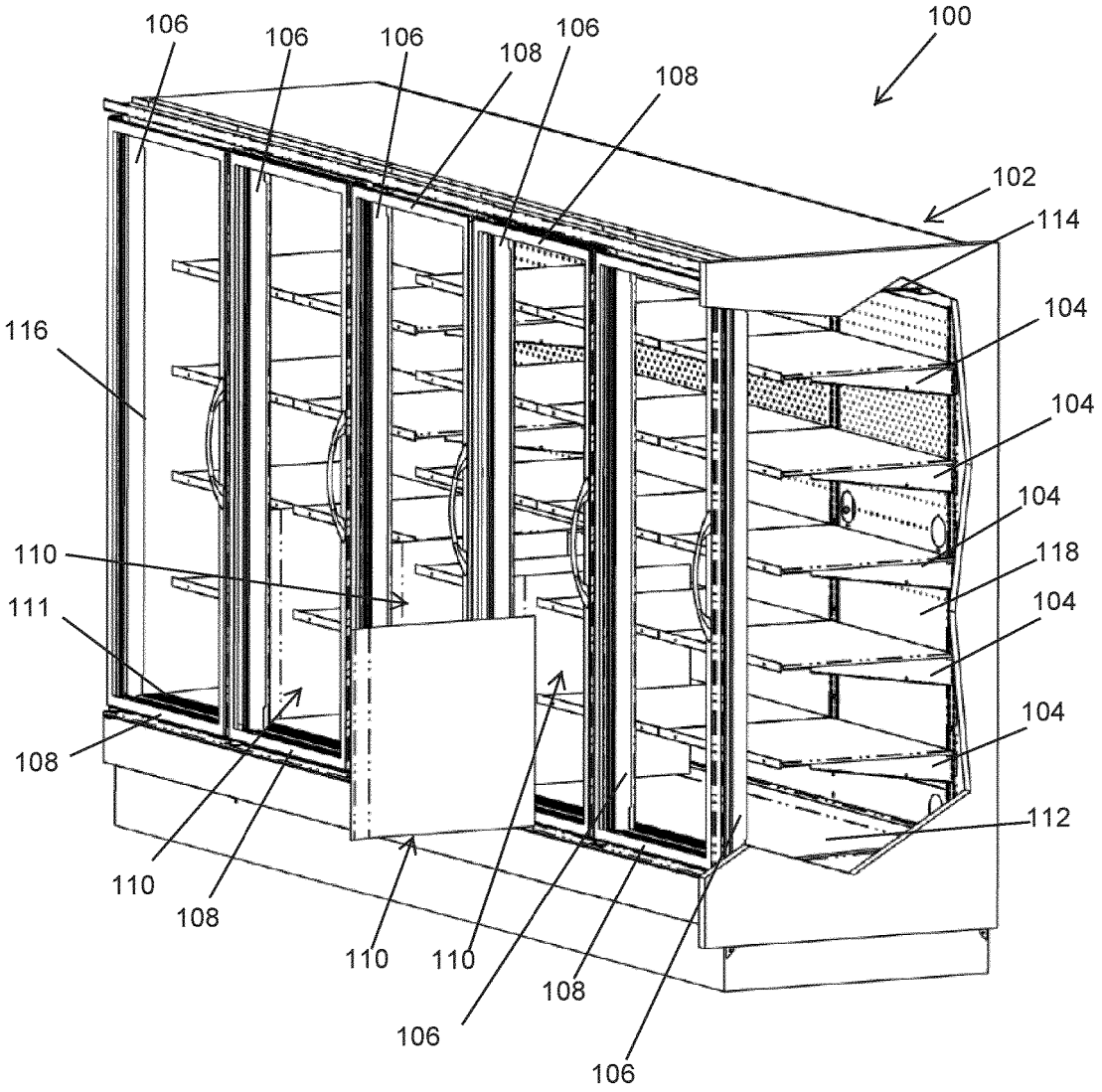
FIG. 1 is perspective, partially exploded view of a refrigerated display case including a number of lateral flow barriers, according to an exemplary embodiment.

Referring to the Figures generally, systems, methods, and apparatuses for lateral flow barriers for a refrigerated display case are shown.

It is common for refrigerated display cases (e.g., closed cases, glass-door cases, etc.) to incorporate several doors for providing access to a refrigerated zone. The refrigerated zone may be cooled by fans that circulate refrigerated air to both remove heat from displayed products (e.g., foods, beverages, etc.) and to establish a protective air-curtain barrier between the refrigerated zone and ambient air when the doors are opened. Each of the doors may be opened independently from the others. In application, certain doors may be opened more frequently than others due to varied popularity of products displayed behind the doors. This popularity corresponds with consumers removing products through the doors and subsequently workers (e.g., grocers, etc.) replenishing (e.g., restocking) or rearranging products through the doors.

The refrigerated display case may be modular such that it can be tailored for a target application. For example, a base refrigerated display case may have a single door but may be coupled to an additional refrigerated display case having a second door. The additional refrigerated display case may or may not be separated from the base refrigerated display case by a thermally insulated barrier. If the additional refrigerated display case is not separated from the base refrigerated display case by a thermally insulated barrier, the refrigerated zone extends into the additional refrigerated display case. In this way, the refrigerated display case can include any number of doors and refrigerated zones. Similarly, this modularity allows a refrigerated zone to be expanded across several doors.

In some applications, thermally insulating barriers may be located between refrigerated display cases (e.g., between the base refrigerated display case and the additional refrigerated display case, etc.). These thermally insulating walls are used primarily to facilitate maintenance and operation of the refrigerate display case. For example, the thermally insulating walls may be an insulated or thick plastic panel to thermally insulate one refrigerated display case from another, thus forming two refrigerated zones. In this way, one refrigerated display case may be turned off for service work while the other refrigerated display case remains in operation. Typically, these thermally insulating walls insulate all areas of the refrigerated display cases from one another such as functional areas under display pans, functional areas behind flue panels, and the display areas which otherwise may be viewed or shopped from doors on both sides of the thermally insulating wall.

While the doors help to reduce overall energy consumption, the doors provide unique challenges to management (e.g., thermal management, etc.) of the refrigerated display cases. For example, a refrigeration load at a given door may be much higher (e.g., an order of magnitude, etc.) when the door is open compared to when the door is closed. When the door is open, ambient air at a first temperature (e.g., twentytwo degrees Celsius, etc.) may enter the refrigerated display case and refrigerated air at a second temperature (e.g., zero degrees Celsius, etc.) may simultaneously exit the refrigerated display case. In this way, the temperature of the air inside the refrigerated zone increases causing added refrigeration load on the refrigerated display case. This refrigeration load increases proportionally with the amount of time that the door remains open. Additionally, the ambient air typically has a higher moisture content (e.g., humidity) than the refrigerated air. Thus, when any of the doors are opened, the moisture content of the air in the refrigerated zone increases.

One of the driving forces behind the exit of refrigerated air from the refrigerated display case is a pressure differential created by opening the door. This pressure differential may encourage refrigerated air to follow the door away from the refrigerated zone when the door is opened, thus causing the air to escape the confines of the refrigerated display case. Similarly, one of the driving forces behind the entry of ambient air into the refrigerated display case is a pressure differential created by closing the door. This pressure differential may force ambient air into the refrigerated display case.

As ambient air accumulates in the refrigerated zone, through transient actions (e.g., opening, closing, etc.) of the doors, moisture content within the refrigerated air may increase. This increase may cause frost and ice accumulation at various locations inside the refrigerated display case, such as on an evaporator coil, on the products, and on the doors. This accumulation may result in decreased efficiency of the refrigerated display case and the inability to maintain a desired temperature and/or temperature gradient inside the refrigerated zone. Similarly, accumulation on products may obscure labels and pricing information.

It is impractical and undesirable to limit the amount of time that one of the doors remains open. For example, consumers may not want to be limited to a specific amount of time within which a product must be selected and retrieved from inside the refrigerated display case. One approach to solving these problems is making it more difficult for ambient air to enter the refrigerated display case while making it more difficult for refrigerated air to leave the refrigerated display case. This approach may facilitate optimization of various aspects of the operation of the refrigerated display case such as optimized valve control, reduced energy usage, and more uniform product temperature within the refrigerated display case.

According to the present disclosure, a refrigerated display case includes a lateral flow barrier that impedes lateral air flow inside the refrigerated display case. For example, the lateral flow barrier impedes the flow of refrigerated air out of the refrigerated display case when a door on the refrigerated display case opens. This is of particular importance if the refrigerated display case includes a plurality of doors where the effects of opening and closing doors can be amplified.

The lateral flow barriers of the present disclosure may improve overall efficiency of the refrigerated display case because the impact of ambient air introduced into the refrigerated display case is mitigated. Similarly, the lateral flow barriers may reduce frost and ice accumulation at various locations inside the refrigerated display case such as on the evaporator coil, on products, and on doors. By reducing this accumulation, less energy is needed to defrost and to drive fans in the refrigerated display case.

As a result of implementing the lateral flow barriers, the refrigerated display case may operate more efficiently and achieve less temperature variance within the refrigerated display case, even when doors of the refrigerated display case are open. The lateral flow barriers of the present disclosure are not intended to be thermally insulating. Further, the lateral flow barriers of the present disclosure are not intended to thermally separate a refrigerated display case. Rather, the lateral flow barriers of the present disclosure are intended to reduce the aforementioned air flow dynamics of refrigerated display cases that occur when doors are opened and closed.

Figure 2:
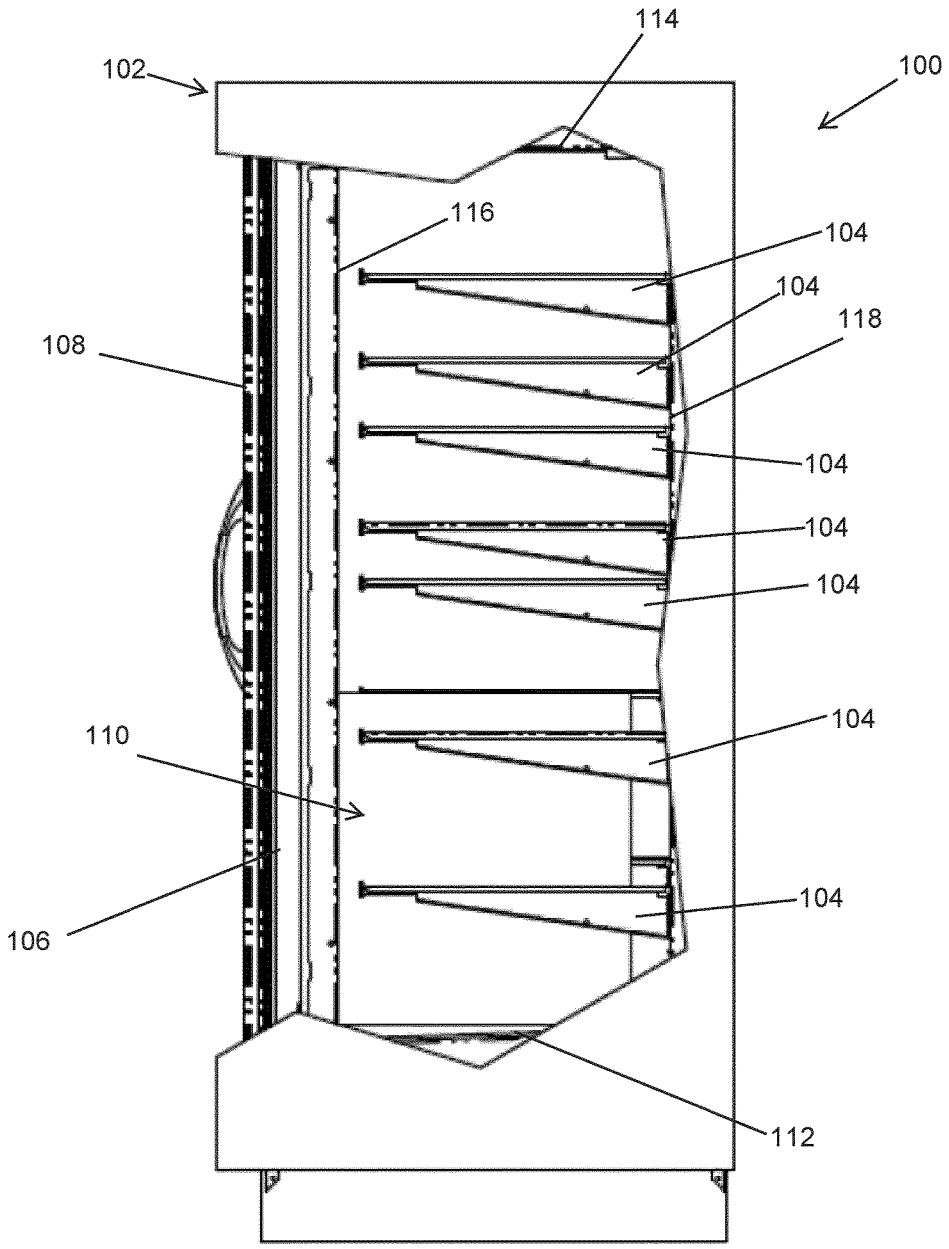
FIG. 2 is a cross-sectional view of the refrigerated display case shown in FIG. 1.
Figure 3:
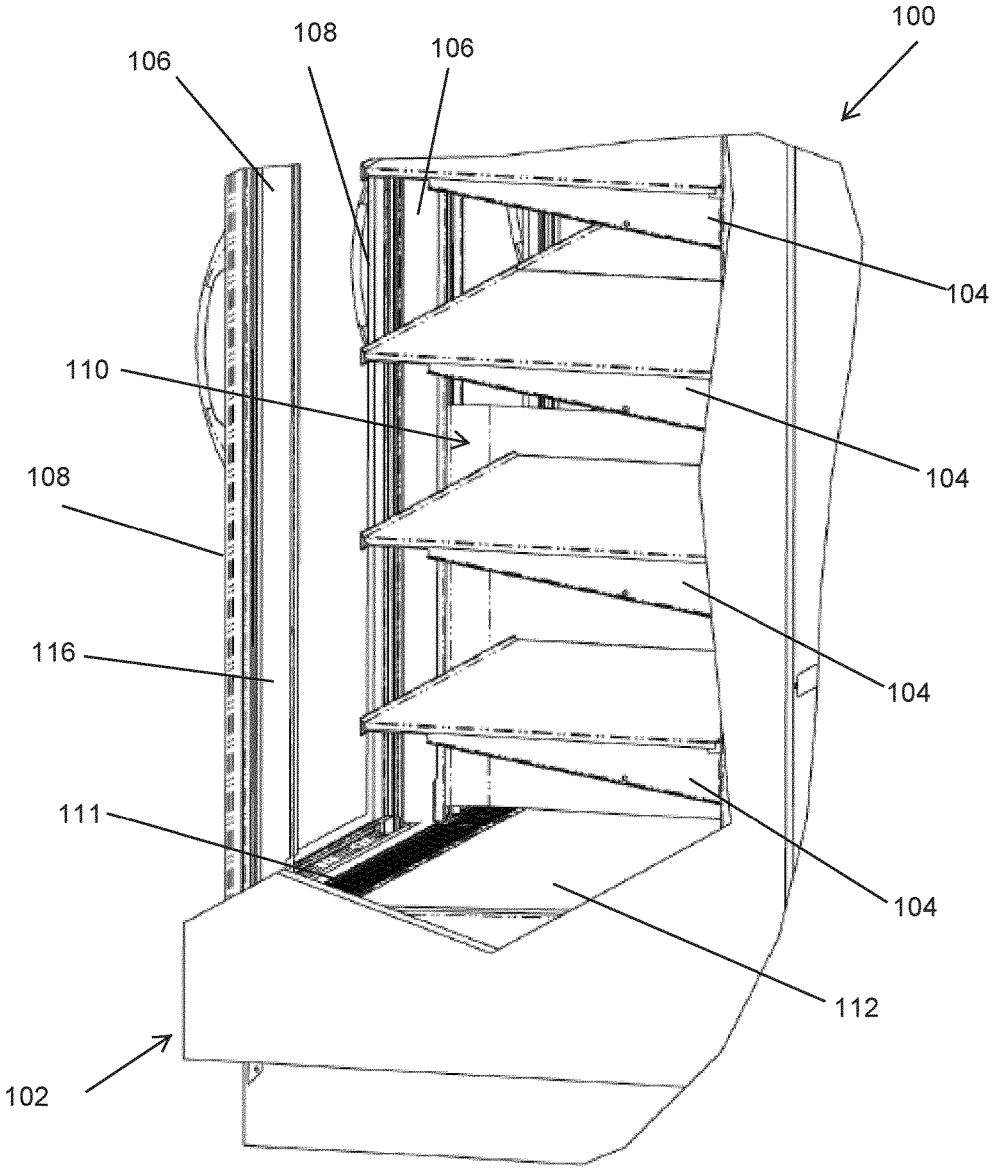
FIG. 3 is a perspective cross-sectional view of the refrigerated display case shown in FIG. 1.

Referring to FIGS. 1-3, a refrigerated display case 100, includes a frame (e.g., body, etc.) 102. In some embodiments, frame 102 includes at least one shelf (e.g., protrusion, flange, etc.) 104. Shelf 104 is configured to receive and support products (e.g., frozen goods, refrigerated goods, meats, cheeses, dairy, beverages, etc.) for display to a consumer (e.g., customer, etc.). Frame 102 includes a plurality of mullions (e.g., posts, columns, beams, etc.) 106 and at least one door (e.g., panel, etc.) 108. Frame 102 is configured such that mullions 106 are located on either side of doors 108. For example, when frame 102 includes two doors 108, frame 102 will include three mullions 106. In this way, mullions 106 may function as both hinge points for doors 108 and sealing surfaces for doors 108.

According to various embodiments, frame 102 is partitioned by mullions 106 such that various components of refrigerated display case 100 are modular. For example, shelves 104 may have a length that is approximately equal to a distance between mullions 106. This modularity allows refrigerated display case 100 to be adapted and tailored for a target application.

Refrigerated display case 100 also includes a plurality of lateral flow barriers (e.g., dividers, restrictors, preventers, reducers, impeders, panels, retainers, etc.) 110. Lateral flow barriers 110 are configured to impede (e.g., reduce, restrict, retain, substantially prevent, etc.) a certain amount of substantially lateral (e.g., left-right, right-left, etc.) flow of refrigerated air within refrigerated display case 100. According to various embodiments, each of the plurality of lateral flow barriers 110 is aligned with one of a plurality of mullions 106. In these embodiments, the number of mullions 106 is at least equal to the number of lateral flow barriers 110. According to an exemplary embodiment, lateral flow barriers 110 are coupled directly to the plurality of mullions 106. In this way, lateral flow barriers 110 are front-justified relative to frame 102. In an alternative embodiment, lateral flow barriers 110 are coupled to an air-curtain return 111 in frame 102.

According to an exemplary embodiment, in refrigerated display case 100, each door 108 is coupled to one mullion 106 as a hinge point and one mullion 106 as a sealing surface. At least one mullion 106 is coupled to lateral flow barrier 110 to at least partially define an first sub-compartment for at least one door 108 and at least one second sub-compartment for the at least one door 108. Lateral flow barriers 110 are configured to impede the flow of refrigerated air from within the at least one second sub-compartment into the first sub-compartment when the at least one door 108 is opened. Further, lateral flow barriers 110 are configured to impede ambient air from entering the at least one second sub-compartment when the at least one door 108 is opened.

Lateral flow barriers 110 are not intended to be thermally insulating walls inside refrigerated display case 100. Rather, lateral flow barriers 110 are intended to impede air flow within refrigerated display case 100. While impeding air flow inside refrigerated display case 100 through the use of lateral flow barriers 110 may impact thermal management of refrigerated display case 100, lateral flow barriers 110 do not function to provide a thermal insulating wall within refrigerated display case 100. Accordingly, lateral flow barriers 110 serve a distinct and different purpose from thermally insulating walls that divide, for example, products at one temperature from products at a higher temperature.

Conventional refrigerated display cases do not include any structure similar to lateral flow barriers 110. When a door on a conventional refrigerated display case is opened, cold and dense air that is directly behind the door pours out and other cold, dense air from behind other doors laterally moves in to replace it. This laterally moving air collides with ambient air from outside the refrigerated display case that is simultaneously entering the case to replace the exiting air. This collision creates vortices in the conventional refrigerated display case which draw in additional ambient air and propel additional cold and dense air from the case. This effect is amplified and propagated when different doors on a conventional refrigerated display case are opened and closed simultaneously. When this happens, additional lateral air movement is created by the high pressure differential from the closing door, and the vortices created at the opening door may be even more impactful. As the number of doors on the conventional refrigerated display case increases, these effects increase.

Lateral flow barriers 110 operate by impeding this substantially lateral air movement within refrigerated display case 100. Depending on the exact configuration of lateral flow barriers 110 and of refrigerated display case 100, this lateral flow may be impeded to varying extents. In one study, lateral flow barriers 110 were found to provide a refrigeration load reduction of approximately seven percent when compared to the refrigeration load without lateral flow barriers 110. By reducing the refrigeration load, refrigerated display case 100 may operate more efficiently. Similarly, refrigerated display case 100 may require less maintenance and servicing because of the use of lateral flow barriers 110. This study also revealed a frost and ice accumulation reduction of approximately thirty percent. This reduction in accumulation may further increase the efficiency of refrigerated display case 100 and in decreased accumulation on products and doors in refrigerated display case 100. These reductions in refrigeration load and accumulation illustrate only some of the benefits lateral flow barriers 110 provide to the operation of refrigerated display case 100.

Lateral movement of cold and dense air in conventional refrigerated display cases is most prevalent and noticeable near a bottom panel of the case. This may be because air-curtains are typically discharged from a top panel of the case and therefore the air-curtains are stronger and more uniform near the top panel, such that lateral movement is impeded, and weaker and less uniform near the bottom panel, such that lateral movement is relatively less impeded. Lateral movement may also be more prevalent near the bottom panel of the case because of the aforementioned vortices and the air density differences (i.e., cold and dense air tends to collect near the bottom of the case, etc.).

According to various embodiments, lateral flow barriers 110 are located near a bottom panel 112 of refrigerated display case 100. In an exemplary embodiment, lateral flow barriers 110 abut (e.g., are in direct contact with, etc.) bottom panel 112 and are directly coupled to mullions 106. In this way, lateral air flow across mullion 106 is impeded proximate bottom panel 112 by lateral flow barriers 110. In some embodiments, lateral flow barriers 110 fit in gaps between two adjacent shelves 104. In this way, lateral movement of lateral flow barriers 110 may be at least partially constrained. In an alternative embodiment, lateral flow barriers 110 are coupled to at least one shelf 104. For example, lateral flow barriers 110 may be coupled to shelves 104 but not mullions 106.

In some applications, mullions 106 include lighting elements (e.g., light emitting diodes, fluorescent lights, light strips, etc.) to illuminate products in refrigerated display case 100. In these applications, lateral flow barriers 110 may curve around one side of the lighting elements. In this way, an air gap between lateral flow barrier 110 and mullions 106 is minimized. Alternatively, the lighting elements may be integrated in lateral flow barriers 110. In this way, lateral flow barriers 110 may couple directly to mullions 106 and the integrated lighting elements on lateral flow barriers 110 may provide illumination. In yet another alternative embodiment, lateral flow barriers 110 and the lighting elements may be integrated within mullions 106 such that mullions 106 act as lateral flow barriers 110.

Figure 4:
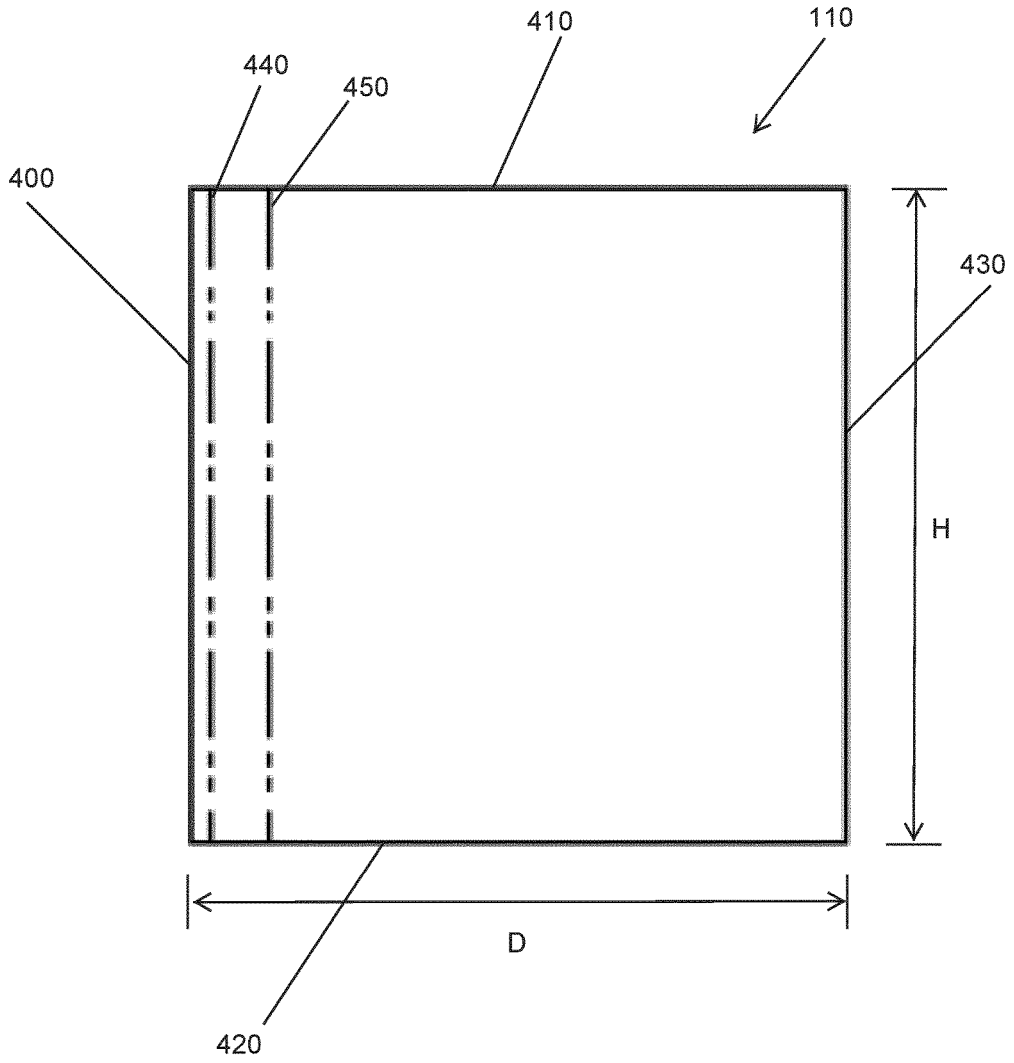
FIG. 4 is a side view of a lateral flow barrier for a refrigerated display case, such as the refrigerated display case shown in FIG. 1, according to an exemplary embodiment.

As shown in FIG. 4, lateral flow barrier 110 includes a front edge 400, a top edge 410, a bottom edge 420, and a rear edge 430. Depending on the shape, lateral flow barrier 110 may include more or less edges. According to various embodiments, front edge 400 of lateral flow barriers 110 is coupled directly to mullions 106. This coupling may be structured such that a gap between lateral flow barriers 110 and mullions 106 is minimized.

In FIG. 4, lateral flow barrier 110 is defined by a depth D and a height H. The depth D may be equal to the greater of the length of top edge 410 or the length of bottom edge 420. Similarly, the height H may be equal to the greater of the length of front edge 400 or the length of rear edge 430. The shape, size, and configuration of lateral flow barriers 110 largely determines the ability of lateral flow barriers 110 to impede lateral air flow across mullion 106. According to an exemplary embodiment, lateral flow barriers 110 are relatively thin and generally rectangular (e.g., depth D is approximately equal to height H, etc.). For example, lateral flow barriers 110 may be approximately one and a half millimeters thick.

Frame 102 may be defined by a common refrigerated zone having an interior height (i.e., from bottom panel 112 to a top panel 114 of frame 102) and an interior depth (i.e., from an inner surface 116 of mullion 106 to a rear surface 118 of frame 102). The depth D and height H of lateral flow barriers 110 may be selected independent from one another such that lateral flow barriers 110 may be tailored for a target application. According to various embodiments, lateral flow barriers 110 have a depth D that is less than the interior depth of frame 102. In some embodiments, lateral flow barriers 110 have a depth D that is between eighty percent and ninety percent of the interior depth of frame 102. However, in other embodiments, lateral flow barriers 110 have a depth D that is approximately equal to the interior depth of frame 102. In these embodiments, lateral flow barriers 110 may be coupled to mullions 106 and to frame 102 (e.g., through brackets, through fasteners, etc.). For example, front edge 400 may be coupled to mullion 106 and rear edge 430 may be coupled to rear surface 118 of frame 102.

Lateral flow barriers 110 may be bottom justified in frame 102 such that lateral flow barriers 110 are in contact with bottom panel 112. According to various embodiments, lateral flow barriers 110 have a height H that is approximately equal to one third of the interior height of frame 102. Lateral flow barriers 110 may have a height H of, for example, 2.54 centimeters (e.g., one inch, etc.). In one embodiment, lateral flow barriers 110 have a height H that is approximately equal to the interior height of frame 102. In an alternative embodiment, lateral flow barriers 110 have height H that is approximately equal to the interior height of frame 102 and a depth D that is approximately equal to an interior depth of frame 102.

In other embodiments, lateral flow barriers 110 have a depth D that is approximately equal to less than ten percent of the interior depth of frame 102. For example, lateral flow barriers 110 may have a depth D that is approximately equal to seven percent of the interior depth of frame 102. In an alternative embodiment, lateral flow barriers 110 have a depth D that is approximately equal to an interior depth of frame 102.

Lateral flow barriers 110 also have a thickness. According to various embodiments, the thickness of lateral flow barriers 110 is relatively small compared to the surface area of lateral flow barriers 110. For example, lateral flow barriers 110 may be on the order of a few millimeters thin.

As shown in FIG. 4, lateral flow barriers 110 include a first bend line 440 and a second bend line 450. First bend line 440 and second bend line 450 may facilitate the tailoring (e.g., trimming, bending, etc.) of lateral flow barriers 110 for use with refrigerated display case 100. For example, first bend line 440 and second bend line 450 may facilitate the bending of lateral flow barriers 110 around lighting elements in mullions 106. First bend line 440 and second bend line 450 may be regions that are less thick than the rest of lateral flow barriers 110. First bend line 440 and second bend line 450 may include a number of perforations or holes. Lateral flow barriers 110 may come pre-bent along first bend line 440 and/or second bend line 450.

First bend line 440 and second bend line 450 may facilitate retrofit applications. In other words, lateral flow barriers 110 may be installed in existing refrigerated display cases 100. Depending on the exact configuration of the existing refrigerated display case 100, lateral flow barriers 110 may need to be installed in different ways and/or tailored for the new refrigerated display case 100. For example, lateral flow barriers 110 may need to be altered (e.g., trimmed, bent, etc.) to fit around different lighting elements on mullions 106. Similarly, it may not be possible to directly couple lateral flow barriers 110 to mullions 106. Rather, lateral flow barriers 110 may be coupled to air-curtain return 111. Further, lateral flow barriers 110 may need to be attached to frame 102 through the use of various brackets (e.g., supports, etc.), fasteners (e.g., screws, nails, etc.), and adhesives (e.g., chalk, glue, etc.). Accordingly, lateral flow barriers 110 may include any number of holes (e.g., threaded holes, etc.) or other attachment features (e.g., quick mounting clips, etc.). Lateral flow barriers 110 may also include magnetic attachment points for coupling to various components of refrigerated display case 100 such as mullions 106.

First bend line 440 and second bend line 450 may be associated with common refrigerated display case types. For example, first bend line 440 may be associated with a first model of refrigerated display case type 100 and second bend line 450 may be associated with a second model of refrigerated display case 100. Thus, lateral flow barriers can be configured for either model of refrigerated display case 100. According to various embodiments, lateral flow barriers 110 are intended to be removable and reusable. If lateral flow barriers 110 are used with a different refrigerated display case 100, the ratio of the height of lateral flow barriers 110 to the interior height of frame 102 may change.

For example, lateral flow barriers 110 may be installed in a first refrigerated display case 100, removed, and then installed in a second refrigerated display case 100 such as in an upgrading installation. Further, in some embodiments, lateral flow barriers 110 are intended to be reconfigurable. For example, when reinstalling lateral flow barriers 110 in a new refrigerated display case 100, it may be desirable to reconfigure lateral flow barriers 110 to better suit the dimensions of the new refrigerated display case 100.

In other embodiments, lateral flow barriers 110 are included in new refrigerated display cases 100. For example, lateral flow barriers 110 may be integrated into mullions 106, shelves 104, and/or frame 102. For example, lateral flow barriers 110 may be integral within bottom panel 112. In some applications, lateral flow barriers 110 may be included with the purchase of new refrigerated display cases 100 and come installed in new refrigerated display cases 100.

Shapes, sizes, and configurations of lateral flow barriers 110 may be selected such that a single lateral flow barrier 110 may be utilized with a variety of different families, brands, and dimensions of refrigerated display cases 100. For example, a single shape, size, and configuration of lateral flow barrier 110 may be utilized for all refrigerated display cases 100 of a common brand.

Lateral flow barriers 110 may have a variety of different shapes such that lateral flow barriers 110 are tailored for a target application. For example, lateral flow barriers 110 may be generally "L" or angle shaped. In these examples, lateral flow barriers 110 may be defined by two or more heights or depths. In one example, front edge 400 has a first length, rear edge 430 has a second length less than the first length, top edge 410 has a third length, bottom edge 420 has a fourth length greater than the third length, top edge 410 is adjacent to a fifth edge having a fifth length, and rear edge 430 is adjacent to a sixth edge having a sixth length, where the first length is approximately equal to the sum of the second length and the fifth length, and where the fourth length is approximately equal to the sum of the third length and the sixth length. These "'L" shaped lateral flow barriers 110 may be particularly advantageous because they will impede a relatively large amount of flow across mullions 106 while facilitating viewing of products on shelves 104.

In other examples, lateral flow barriers may resemble various rhomboids, parallelograms, designs, logos, arrows, and other irregular shapes such that lateral flow barriers 110 may be tailored for a target application. In some embodiments, any of front edge 400, top edge 410, bottom edge 420, and rear edge 430 are slanted, angled, or otherwise sloped. For example, top edge 410 may be sloped downwards directly to bottom edge 420, where rear edge 430 is removed.

In various examples, lateral flow barriers 110 may be extruded, thermoformed, vacuum formed, stamped, cut, molded (e.g., injection molded, blow molded, etc.), of otherwise formed into a target shape. According to some embodiments, lateral flow barrier 110 is formed via a punching and forming process. In other embodiments, lateral flow barrier 110 is formed via a stamping process. In some alternative embodiments, lateral flow barriers 110 are formed via a material removal process (e.g., cutting, laser cutting, water jetting, milling, drilling, machining, etc.).

Lateral flow barriers 110 may be constructed from various materials such as plastic materials (e.g., polymeric materials, etc.), glass materials, composite materials, metallic materials (e.g., aluminum, steel, stainless steel, etc.), or other suitable materials. According to various embodiments, lateral flow barriers 110 are transparent or translucent. In this way, lateral flow barriers 110 may facilitate visualization of products on shelves 104 by consumers, making refrigerated display case 100 more desirable. Further, this may allow light to more easily propagate within refrigerated display case 100 to illuminate products. In one embodiment, lateral flow barriers 110 are constructed from clear plastic sheets. In another embodiment, lateral flow barriers 110 are constructed from polycarbonate plastic. Lateral flow barriers 110 may be frosted or otherwise colored. Lateral flow barriers 110 may also be textured. In some alternative embodiments, lateral flow barriers 110 may be opaque. For example, lateral flow barriers 110 may be painted to match an interior color scheme of a grocery store. Alternatively, lateral flow barriers 110 may be utilized to display advertisements or other information (e.g., pricing, promotions, nutrient information, etc.). Lateral flow barriers 110 may also incorporate display screens (e.g., electronic display screens, etc.).

According to various embodiments, lateral flow barriers 110 are at least partially reflective. Lateral flow barriers 110 may be constructed from glass, plastic, or metallic material. For example, lateral flow barriers 110 may be constructed from stainless steel with a mirror and/or bright finish. Lateral flow barriers 110 may also be painted or coated in reflective material (e.g., covered in metallic paint, etc.). Alternatively, lateral flow barriers 110 may include a mirror (e.g., surface, reflector, etc.). The mirrors may be configured to be permanently or removably attached to lateral flow barriers 110. The mirrors may be positioned at an angle relative to shelf 104 to facilitate viewing of products at different angles. The mirrors may also be selectively repositioned between various positions configured to redirect an image of shelf 104 to a consumer.

In some embodiments, lateral flow barriers 110 are horizontally segmented such that a portion of lateral flow barriers 110 proximate products on shelves 104 is reflective and a portion proximate mullion 106 is transparent and/or translucent, and vice versa. In other embodiments, lateral flow barriers 110 are vertically segmented to include reflective portions proximate products on shelves 104 and transparent and/or translucent portions between shelves 104, and vice versa.

According to various embodiments, not all mullions 106 in refrigerated display case 100 include lateral flow barriers 110. For example, lateral flow barriers 110 may not be located on mullions 106 where large products are displays across these mullions 106. Similarly, different shapes, sizes, and configurations of lateral flow barriers 110 may be provided at various locations within refrigerated display case 100. For example, larger lateral flow barriers 110 may be alternated with smaller lateral flow barriers 110. Further, lateral flow barriers 110 of different materials and/or constructions (e.g., reflective, etc.) may be alternated. Still further, lateral flow barriers 110 having different mounting mechanisms (e.g., coupled to mullion 106, coupled to bottom panel 112, etc.) may be alternated. In some embodiments, refrigerated display case 100 includes only a single lateral flow barrier 110. In other embodiments, refrigerated display case 100 includes three or more lateral flow barriers 110 for each door 108 included in the refrigerated display case 100.

In some embodiments, lateral flow barriers 110 are reconfigurable (e.g., selectively repositionable, etc.) between a plurality of positions and operational states. For example, lateral flow barriers 110 may be manually adjustable via a fastener (e.g., a tool-less fastener, etc.). Lateral flow barriers 110 may also be movable within a track defining several positions such that an operator may locate lateral flow barriers 110 manually in one of the positions. This track may facilitate movement along mullions 106, along bottom panel 112, along top panel 114, and/or along shelves 104.

In some alternative embodiments, lateral flow barriers 110 are configured to be modular. For example, lateral flow barriers 110 may receive extension pieces for facilitating the impedance of additional flow within refrigerated display case 100. These extension pieces may be selectively deployed to provide additional flow impedance when desired, such during warm times of the year when refrigeration loads are typically higher. Alternatively, these extension pieces may be built into lateral flow barriers 110 and may be selectively deployable from lateral flow barriers 110. For example, these extension pieces may be telescopically contained within lateral flow barriers 110.

Lateral flow barriers 110 may incorporate other devices, structures, and mechanisms that assist in various operations of refrigerated display case 100. For example, lateral flow barriers 110 may incorporate other devices, structures, and mechanisms that assist in maintaining the air-curtain, advertising products to consumers, illuminating shelves 104, providing operational data (e.g., temperature, flow rates, usage rates, product quantities, etc.), and other similar objectives.

Lateral flow barriers 110 may be utilized by a variety of different refrigeration applications. For example, lateral flow barriers 110 may be utilized in commercial refrigerators, residential refrigerators, industrial refrigerators, refrigerated display cases, freezers, chest freezers, air conditioning units, refrigerated vehicles, refrigerated tractor trailers, refrigerated compartments, refrigerated packages, and other similar applications. Lateral flow barriers 110 may be implemented in, for example, low-temperature applications (e.g., the display of frozen cakes and frozen ice cream, etc.) and medium-temperature applications (e.g., dairy, fresh meats, fish, produce, beverages, etc.). Lateral flow barriers 110 may also be implemented where refrigerated display case 100 is intended for dual-temperature operation such that refrigerated display case 100 may selectively establish a low-temperature environment and a medium-temperature environment.

Lateral flow barriers 110 are not limited by the design of door 108. For example, lateral flow barriers 110 may be implemented with "French doors," vertically sliding doors, horizontally sliding doors, rotational doors, wide doors, tall doors, removable doors, and other similar doors.

The embodiments described herein have been described with reference to drawings. The drawings illustrate certain details of specific embodiments that implement the systems, methods and programs described herein. However, describing the embodiments with drawings should not be construed as imposing on the disclosure any limitations that may be present in the drawings.

The present disclosure is not limited to the particular methodology, protocols, and expression of design elements, etc., described herein and as such may vary. The terminology used herein is for the purpose of describing particular embodiments only, and is not intended to limit the scope of the present disclosure.

As used herein, the singular forms include the plural reference and vice versa unless the context clearly indicates otherwise. The term "or" is inclusive unless modified, for example, by "either." For brevity and clarity, a particular quantity of an item may be described or shown while the actual quantity of the item may differ. Other than in the operating examples, or where otherwise indicated, all numbers expressing measurements used herein should be understood as modified in all instances by the term "about," allowing for ranges accepted in the art.

Unless defined otherwise, all technical terms used herein have the same meaning as those commonly understood to one of ordinary skill in the art to which this invention pertains. Although any known methods, devices, and materials may be used in the practice or testing of the inventive concepts, the methods, devices, and materials in this regard are described herein.

The foregoing description of embodiments has been presented for purposes of illustration and description. It is not intended to be exhaustive or to limit the disclosure to the precise form disclosed, and modifications and variations are possible in light of the above teachings or may be acquired from this disclosure. The embodiments were chosen and described in deposit to explain the principals of the disclosure and its practical application to enable one skilled in the art to utilize the various embodiments and with various modifications as are suited to the particular use contemplated. Other substitutions, modifications, changes and omissions may be made in the design, operating conditions and arrangement of the embodiments without departing from the scope of the present disclosure.

The invention claimed is:

1. A refrigerated display case comprising:

a frame defining a common refrigerated zone, the frame comprising:

a first mullion; and a second mullion;

a door hingedly mounted to the first mullion and configured to selectively interface with the second mullion; and a lateral flow barrier coupled to one of the first mullion and the second mullion, the lateral flow barrier extending into the common refrigerated zone, the common refrigerated zone defined by a first depth and the lateral flow barrier defined by a second depth less than the first depth;

wherein the lateral flow barrier partially separates the common refrigerated zone into a first sub-compartment proximate the door and bounded by the lateral flow barrier and a second sub-compartment opposite the first sub-compartment; and wherein the lateral flow barrier is constructed from at least one of plastic, glass, or metal.

2. The refrigerated display case of claim 1, wherein air from the second sub-compartment is substantially prevented from flowing into the first sub-compartment when the door is opened.

3. The refrigerated display case of claim 2, wherein ambient air from outside of the refrigerated display case is substantially prevented from flowing into the second sub-compartment when the door is opened.

4. The refrigerated display case of claim 3, further comprising:

a second door hingedly mounded to the second mullion;

the frame further comprising a third mullion, the third mullion configured to selectively interface with the second door; and a second lateral flow barrier;

wherein the lateral flow barrier is coupled to the first mullion;

wherein the second lateral flow barrier is coupled to the second mullion, the second lateral flow barrier extending into the common refrigerated zone;

wherein the first sub-compartment is located between the lateral flow barrier and the second lateral flow barrier; and wherein the second lateral flow barrier partially separates the common refrigerated zone into a third sub-compartment proximate the second door and bounded by the second lateral flow barrier.

5. The refrigerated display case of claim 3, wherein the lateral flow barrier is at least partially transparent.

6. The refrigerated display case of claim 3, wherein the lateral flow barrier is at least partially reflective.

7. The refrigerated display case of claim 3, wherein the lateral flow barrier is relatively thin compared to a surface area of the lateral flow barrier; and wherein the lateral flow barrier is flexible.

8. The refrigerated display case of claim 7, wherein the lateral flow barrier bends around the first mullion.

9. The refrigerated display case of claim 3, further comprising:

a first shelf located above the first sub-compartment; and a second shelf located above the second sub-compartment;

wherein the lateral flow barrier is located within a gap between the first shelf and the second shelf.

* * * * *